US010336563B2

(12) United States Patent
Fuchi

(10) Patent No.: US 10,336,563 B2
(45) Date of Patent: Jul. 2, 2019

(54) SHEET FEEDING APPARATUS INCLUDING SHEET STORAGE UNIT WHICH CAN BE PUSHED INTO OR PULLED OUT OF APPARATUS BODY, AND IMAGE FORMING APPARATUS

(71) Applicant: KYOCERA Document Solutions Inc., Osaka-shi (JP)

(72) Inventor: Masami Fuchi, Osaka (JP)

(73) Assignee: KYOCERA Document Solutions INc., Osaka-shi, Osaka (JP)

( * ) Notice: Subject to any disclaimer, the term of this patent is extended or adjusted under 35 U.S.C. 154(b) by 6 days.

(21) Appl. No.: 15/888,272

(22) Filed: Feb. 5, 2018

(65) Prior Publication Data

US 2018/0222701 A1 Aug. 9, 2018

(30) Foreign Application Priority Data

Feb. 6, 2017 (JP) ..... 2017-019573

(51) Int. Cl.

| | |
|---|---|
| ***B65H 1/14*** | (2006.01) |
| ***B65H 1/04*** | (2006.01) |
| ***B65H 1/12*** | (2006.01) |
| ***B65H 5/06*** | (2006.01) |
| ***B65H 1/26*** | (2006.01) |

(52) U.S. Cl.

CPC ..... *B65H 1/14* (2013.01); *B65H 1/04* (2013.01); *B65H 1/12* (2013.01); *B65H 1/266* (2013.01); *B65H 5/06* (2013.01); *B65H 2405/1117* (2013.01); *B65H 2405/1122* (2013.01); *B65H 2405/1124* (2013.01); *B65H 2801/06* (2013.01)

(58) Field of Classification Search

CPC ..... B65H 2405/1124; B65H 1/14; B65H 2405/1117; B65H 2405/1122

See application file for complete search history.

(56) References Cited

U.S. PATENT DOCUMENTS

| | | | | |
|---|---|---|---|---|
| 5,806,844 | A * | 9/1998 | Bailey | G03B 42/045 271/145 |
| 6,984,084 | B2 * | 1/2006 | Ng | B41J 13/103 271/145 |
| 7,661,671 | B2 * | 2/2010 | Yamazaki | B65H 29/246 271/211 |
| 8,083,222 | B2 * | 12/2011 | Nakano | B65H 1/266 271/121 |

(Continued)

FOREIGN PATENT DOCUMENTS

JP 2012-166861 9/2012

*Primary Examiner* — Howard J Sanders
(74) *Attorney, Agent, or Firm* — Gerald E. Hespos; Michael J. Porco; Matthew T. Hespos

(57) ABSTRACT

The sheet feeding apparatus includes a first cursor. The first cursor comes in contact with a side face of a stack of sheets, and can move between a restriction position and a retracted position. The lift plate includes a fixed plate and a movable plate. The stack of sheets is movable together with the movable plate in the push-in/pull-out direction. When the sheet storage unit is pushed into the apparatus body, the first cursor moves by inertia of the stack of sheets, against an urging force of an urging member, toward the retracted position. After the sheet storage unit has reached the accommodated position, the first cursor pushes the stack of sheets by resilience of the urging member to move to the restriction position.

12 Claims, 13 Drawing Sheets

(56) References Cited

U.S. PATENT DOCUMENTS

| | | | | |
|---|---|---|---|---|
| 8,439,343 | B2 * | 5/2013 | Yamaguchi | B65H 1/14 271/162 |
| 2012/0205861 | A1 | 8/2012 | Yamaguchi | |
| 2017/0313528 | A1 * | 11/2017 | Yang | B65H 1/14 |

* cited by examiner

SHEET FEEDING APPARATUS INCLUDING SHEET STORAGE UNIT WHICH CAN BE PUSHED INTO OR PULLED OUT OF APPARATUS BODY, AND IMAGE FORMING APPARATUS

INCORPORATION BY REFERENCE

This application is based on Japanese Patent Application No. 2017-19573 filed on Feb. 6, 2017 to the Japan Patent Office, the contents of which are incorporated by reference.

BACKGROUND

The present disclosure relates to a sheet feeding apparatus and an image forming apparatus, in particular, to an art of reducing deformation and breakage of a cursor of a sheet storage unit that stores sheets.

An image forming apparatus such as a printer, a copying machine, and a facsimile includes a sheet feeding apparatus for feeding a sheet, a sheet conveying unit for conveying a sheet fed by the sheet feeding apparatus, and an image forming unit that forms an image on a sheet conveyed by the sheet conveying unit.

A drawer type sheet storage unit is used in some sheet feeding apparatuses, providing simpleness to a user who supplies sheets. A user supplies sheets by pulling out the sheet storage unit along a rail provided in the apparatus body, supplying sheets, and pushing the sheet storage unit into the apparatus body to a accommodated position.

Sheet storage units for different sheet sizes are provided in the sheet feeding apparatus. A sheet storage unit that stores sheets of a frequently used size has a large storage space. Such a sheet storage unit having the large storage space has a mechanism to suspend a lift plate, which is a bottom plate on which a stack of sheets is placed, by a wire which is pulled or released by a motor provided in a main body of the image forming apparatus to raise and lower the stack of sheets on the lift plate.

Furthermore, the sheet storage unit of the sheet feeding apparatus is provided with a cursor that restricts an end of the stack of sheets. In a storage space of the sheet storage unit, the cursor keeps the end of the stack of sheets at a specified position to avoid skewing of a sheet when the sheet is conveyed.

SUMMARY

A sheet feeding apparatus according to one aspect of the present disclosure includes an apparatus body, a sheet storage unit, a lift plate, a lift unit, a first cursor, and an urging member.

The sheet storage unit has a storage space which is opened to an upper side and stores a stack of sheets. The sheet storage unit can be pushed into and pulled out of the apparatus body.

The lift plate is disposed parallel to a bottom of the storage space and can be raised and lowered.

The lift unit raises and lowers the lift plate.

The first cursor is provided upright on the bottom at the back side in the push-in direction in which the sheet storage unit is pushed into the apparatus body. The first cursor restricts the end in the back side of the stack of sheets.

The urging member disposed between a back side wall and the first cursor to urge the first cursor, the back side wall defining an end in the back side of the storage space, the urging member being elastically deformable in a push-in/pull-out directions.

The first cursor comes in contact with a first side face, which is a side face of the stack of sheets, and can move between a restriction position where the first cursor restricts the stack of sheets from moving in the push-in direction and a retracted position to which the first cursor retracts in the back side from the restriction position.

The lift plate includes a fixed plate connected to the lift unit and a movable plate on which the stack of sheets is placed, the movable plate being movable on the fixed plate in the push-in/pull-out direction.

By inertia force of the stack of sheets, which generates when the sheet storage unit is pushed into the apparatus body and stops at a predetermined position, the stack of sheets moves together with the movable plate to the back side of the storage space to push the first cursor, the first cursor moves, by the inertia against an urging force of the urging member, to the retracted position and then pushes back the stack of sheets by resilience of the urging member to the restriction position.

An image forming apparatus according to one aspect of the present disclosure includes a sheet feeding apparatus, a sheet conveying unit, and an image forming unit. In the image forming apparatus according to the aspect, the sheet feeding apparatus described above is employed as the sheet feeding apparatus.

BRIEF DESCRIPTION OF THE DRAWING

FIG. 8 is a schematic perspective view illustrating a region of the rear wall where the guide pins pass through;

DETAILED DESCRIPTION

An embodiment of the present disclosure will be described with reference to the drawings. It should be noted that the embodiment described below is one aspect of the present disclosure. The embodiment is disclosed by means of illustration and not by means of limitation except for the essential configuration.

In the following description, the term "sheet" means a sheet material, such as a copying paper, a coated paper, an OHP sheet, a cardboard, a postcard, a tracing paper, a sheet material subjected to image forming processing, and a sheet material subjected to any processing other than image forming processing.

The term "stack of sheets" means a plurality of sheets stacked in the thickness direction thereof as described above.

(First Embodiment)

1. Schematic Configuration of Image Forming Apparatus 1

A schematic configuration of the image forming apparatus 1 according to the present embodiment will be described with reference to FIG. 1.

Figure 1:
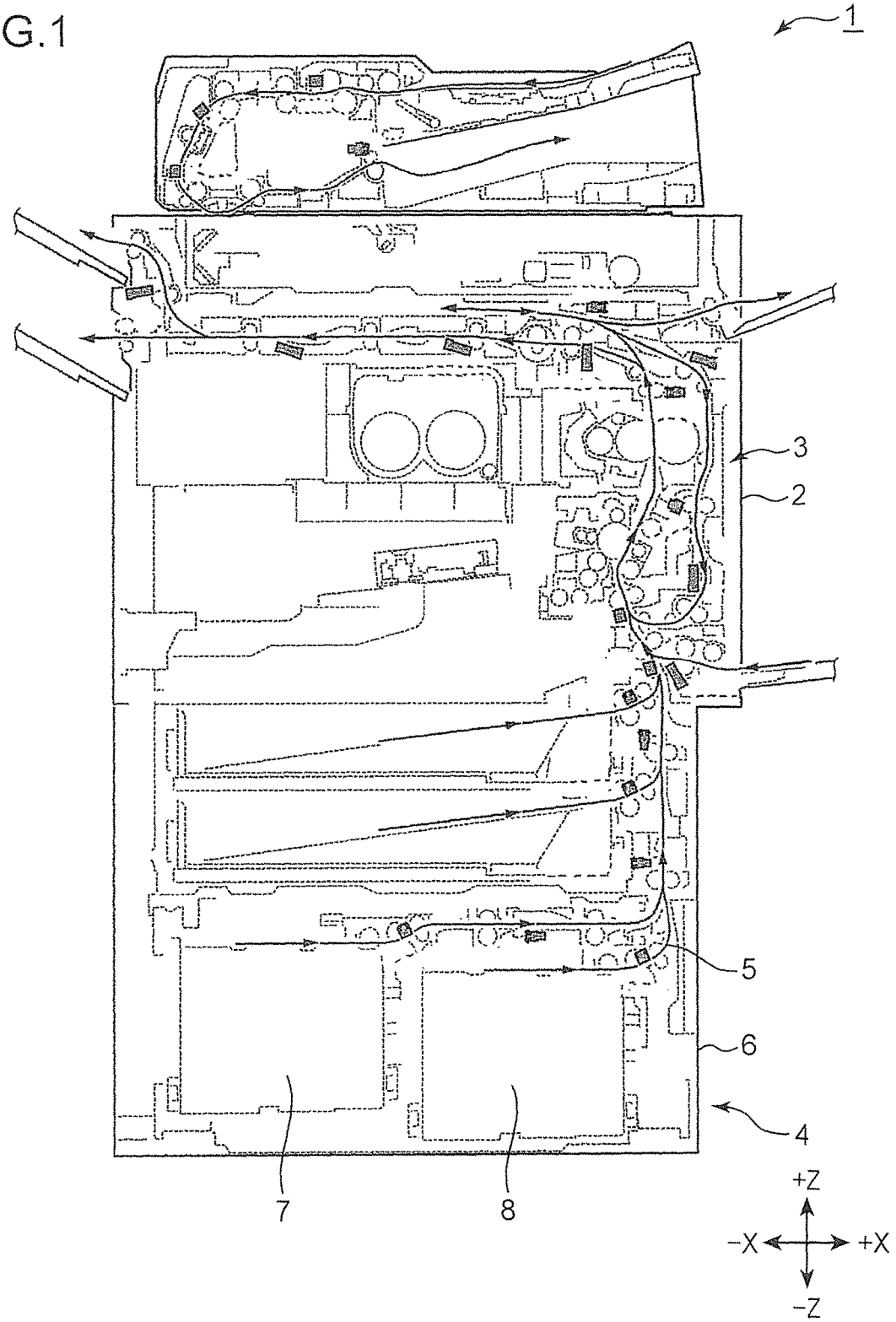
FIG. 1 is a schematic view illustrating a schematic configuration of an image forming apparatus according to a first embodiment.

As illustrated in FIG. 1, the image forming apparatus 1 according to the present embodiment includes a sheet feeding apparatus 4 that feeds a sheet, a sheet conveying unit 5 that conveys the fed sheet, an image forming unit 3 that forms an image on the conveyed sheet.

The sheet feeding apparatus 4 includes an apparatus body 6 disposed in the lower part (the part in −Z side) of the image forming apparatus 1. The sheet feeding apparatus 4 can be removed from the main body 2 of the image forming apparatus 1. The sheet feeding apparatus 4 includes a sheet storage unit 7 and a sheet storage unit 8.

The image forming unit 3 is housed inside the main body 2 of the image forming apparatus 1. The sheet conveying unit 5 passes through the main body 2 and the sheet feeding apparatus 4 in the image forming apparatus 1.

2. Configuration of Sheet Feeding Apparatus 4

Figure 2:
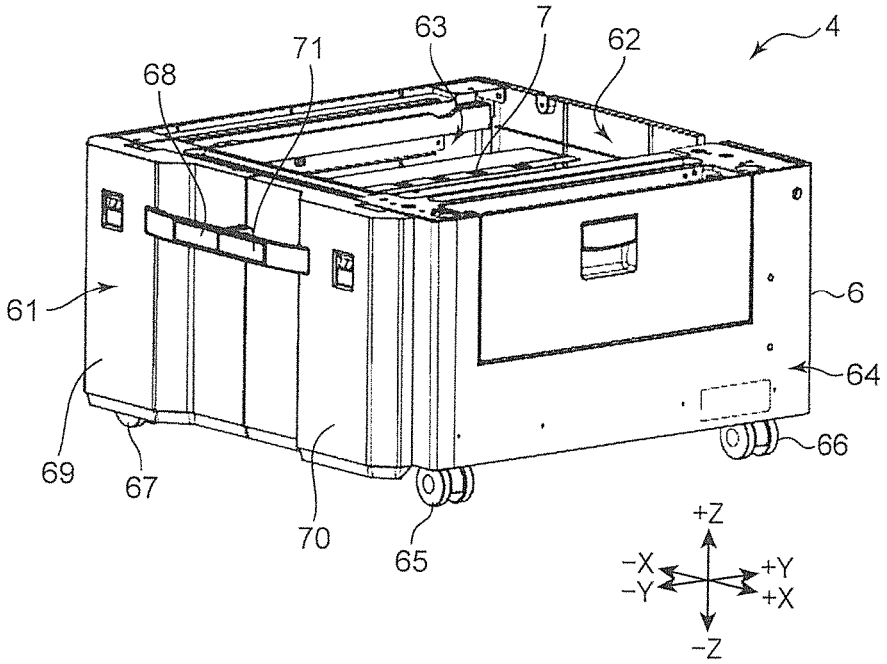
FIG. 2 is a schematic perspective view illustrating a configuration of a sheet feeding apparatus of the image forming apparatus.
Figure 3:
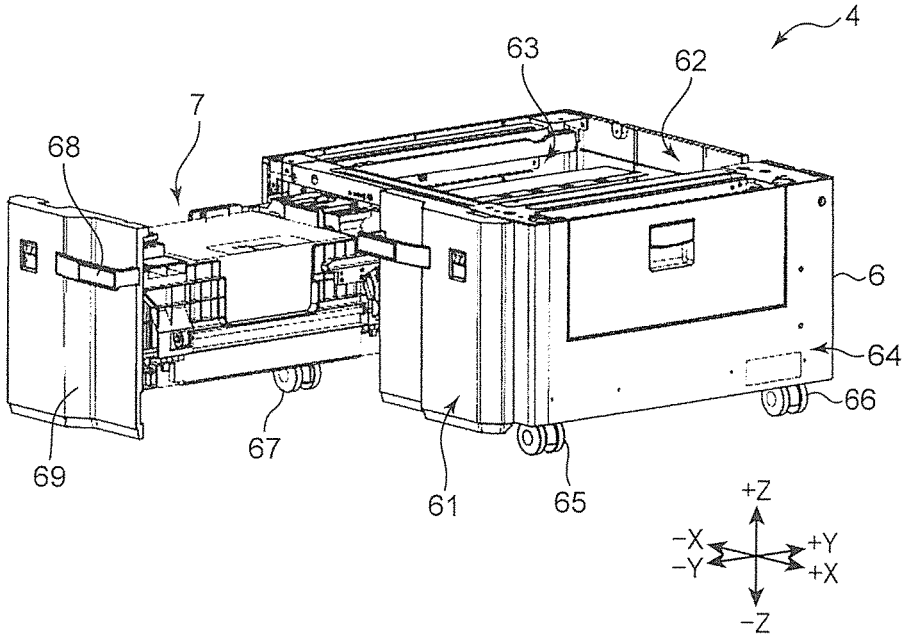
FIG. 3 is a schematic perspective view illustrating a sheet storage unit of the sheet feeding apparatus.

The configuration of the sheet feeding apparatus 4 will be described with reference to FIGS. 2 and 3. FIG. 2 is a schematic perspective view illustrating the configuration of the sheet feeding apparatus 4 provided in the apparatus body 6. FIG. 3 is a schematic perspective view illustrating the sheet feeding apparatus 4 with the sheet storage unit 7 pulled out.

As illustrated in FIGS. 2 and 3, the apparatus body 6 of the sheet feeding apparatus 4 has a form of a box that is opened to the upper side (+Z side) and has a circumference formed by a front wall 61, a rear wall 62, side walls 63 and 64, and a bottom wall (not shown). The front wall 61 includes a door 69 in −X side and a door 70 in +X side.

On the bottom wall of the apparatus body 6, four casters (only three casters 65, 66, and 67 are illustrated in FIGS. 2 and 3 for convenience of illustration) are provided, and on the front wall 61, handles 68 and 71 are provided. The sheet feeding apparatus 4 including the apparatus body 6 configured as described above is detachable from the main body 2 of the image forming apparatus 1.

In the sheet feeding apparatus 4, a sheet storage unit 7 and a sheet storage unit 8 capable of storing a stack of sheets, which is a plurality of stacked sheets, are provided side by side in X direction (see FIG. 1). Although not illustrated in detail, a pickup roller, a sheet feeding roller, and a separating unit are provided to each of the sheet storage units 7 and 8.

As illustrated in FIG. 3, the sheet feeding apparatus 4 is configured such that the sheet storage unit 7 is pulled out by a user holding the handle 68 pulling the door 69 to −Y side. Similarly, the sheet storage unit 8 is pulled out by a user holding the handle 71 (see FIG. 2) pulling the door 70 to −Y side (see FIG. 1).

As illustrated in FIG. 1, a relay conveyance path is provided in +Z side (upper side) of each of the sheet storage units 7 and 8 to feed out a fed sheet from each of the sheet storage units 7 and 8 to the sheet conveying unit 5 in +X side.

3. Configuration of Sheet Storage Unit 7

Figure 4:
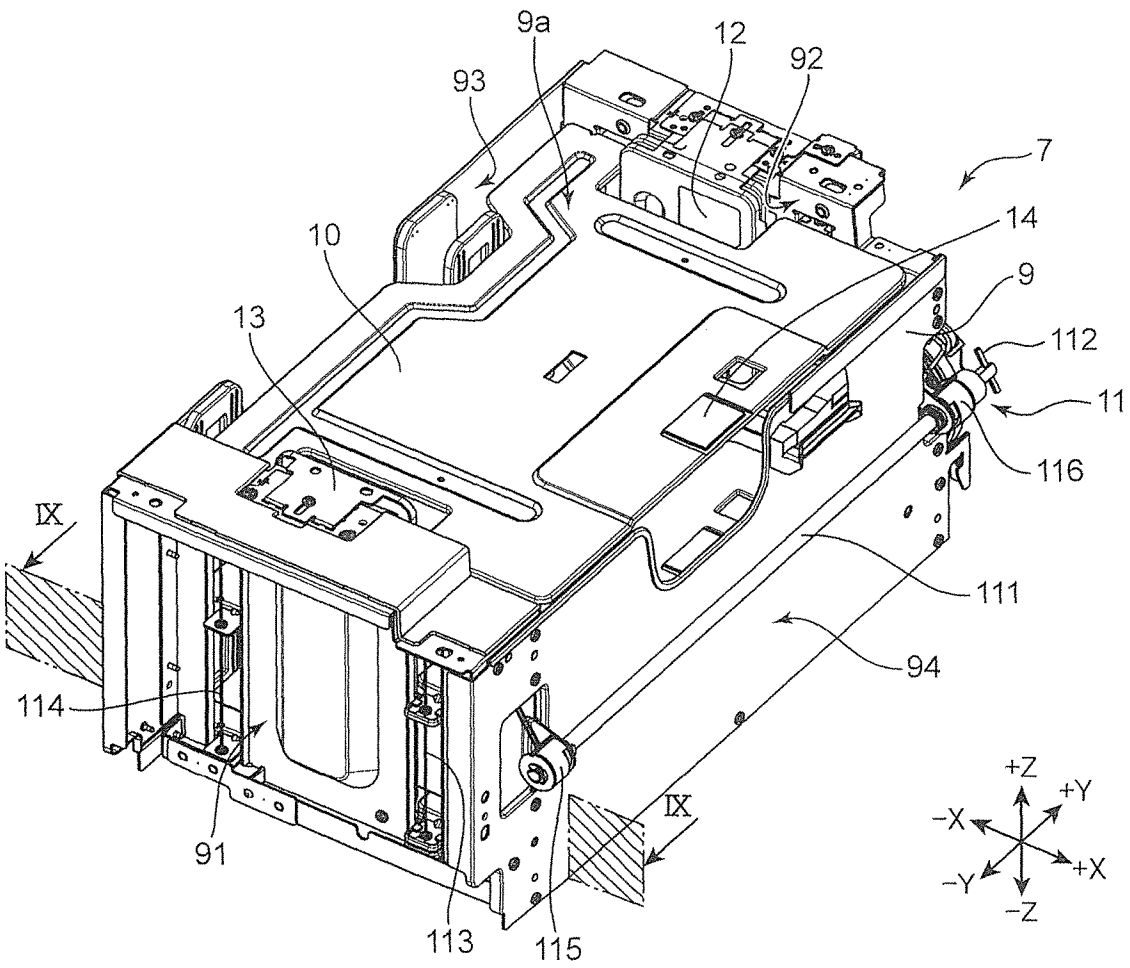
FIG. 4 is a schematic perspective view illustrating a configuration of the sheet storage unit.
Figure 5:
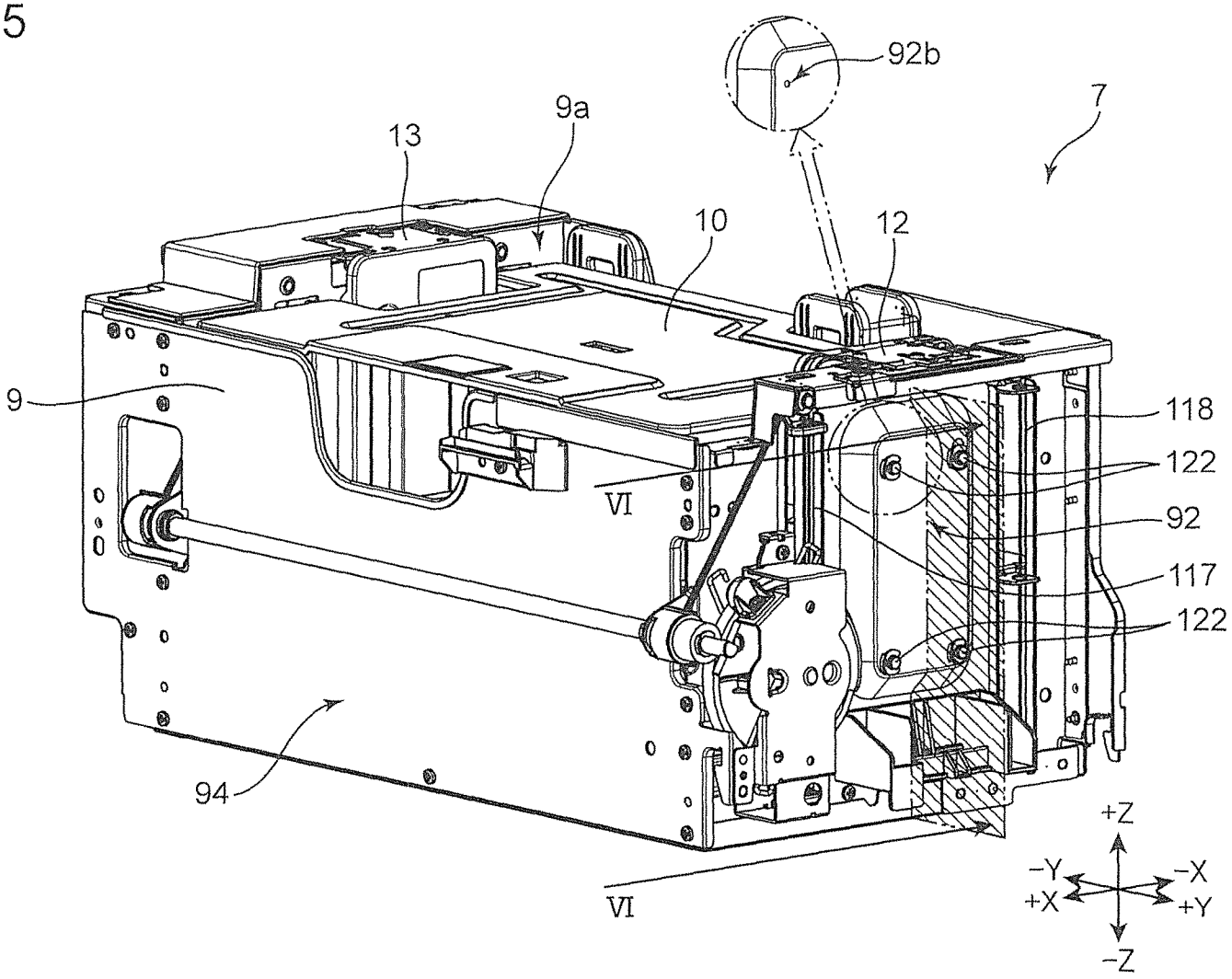
FIG. 5 is a schematic perspective view illustrating a configuration of the sheet storage unit.

The configuration of the sheet storage unit 7 of the sheet feeding apparatus 4 will be described with reference to FIGS. 4 and 5. FIG. 4 is a schematic perspective view of the sheet storage unit 7 viewed diagonally from above. FIG. 5 is a schematic perspective view viewed diagonally from the opposite side with respect to Y direction.

As illustrated in FIGS. 4 and 5, the sheet storage unit 7 has a form of a box that is opened to the upper side (+Z side) and includes a storage housing 9 having inside a storage space **9*a* in which a stack of sheets is stored. A circumferential wall of the storage housing 9 is formed by a front wall 91, a rear wall 92 (corresponding to the back side wall), side walls 93 and 94**, and a bottom wall (not shown).

In the storage space **9*a* of the storage housing 9, a lift plate 10 that is lifted and lowered in Z direction is provided. The upper face (face in +Z side) of the lift plate 10 is the face on which the stack of sheets is placed. The lift unit 11 lifts and lowers the lift plate 10**.

A feed pad 14 is attached to a portion of the lift plate 10 in +X side. The feed pad 14 is made of, for example, non-woven fabric and prevents double feeding.

The lift unit 11 includes a rotating shaft 111, a joint section 112, wires 113, 114, 117, and 118, and wire winding sections 115 and 116. The rotating shaft 111 extends in Y direction and is rotatably supported to oppose the outer face of the side wall 94.

Although not illustrated in detail, the wires 113 and 114 are connected to a portion of the lift plate 10 in −Y side with an end of the wire 113 and an end of the wire 114 separated apart in X direction. The other end of the wire 113 and the other end of the wire 114 are connected to the wire winding section 115 via pulleys (not illustrated).

Similarly, the wires 117 and 118 are connected to a portion of the lift plate 10 in +Y side with an end of the wire 117 and an end of the wire 118 separated apart in X direction. The other end of the wire 117 and the other end of the wire 118 are connected to the wire winding unit 116 via pulleys (not illustrated).

The joint section 112 is provided on the end of the rotating shaft 111 in +Y side and connects with a drive shaft of a lift motor provided in the main body 2 of the image forming apparatus 1. With the drive shaft of the lift motor connected with the joint section 112, the rotating shaft 111 rotates or counter rotates in conjunction with the rotating lift motor. One end of each of the wires 113, 114, 117, and 118 is connected to the lift plate 10, and the wires 113, 114, 117, and 118 are wound up and wound out by the wire winding sections 115 and 116.

The lift plate 10 is lifted as the wires 113, 114, 117, and 118 are wound up by the wire winding sections 115 and 116, and lowered as the wires 113, 114, 117, and 118 are wound out by the wire winding sections 115 and 116.

A second cursor (guide, stopper) 13 is provided in the inner side of the front wall 91 of the storage housing 9. A first cursor (guide, stopper) 12 is provided in the inner side of the rear wall 92 of the storage housing 9.

As specifically illustrated in a portion surrounded by a double-dashed chain line in FIG. 5, four through holes **92*b* are formed in the rear wall 92. The distal portion of the guide pin 122, which constitutes a part of the first cursor 12, passes through and protrudes from each of the through holes 92*b***.

4. Configuration of First Cursor 12 and Peripheral Configuration Thereof

Figure 6:
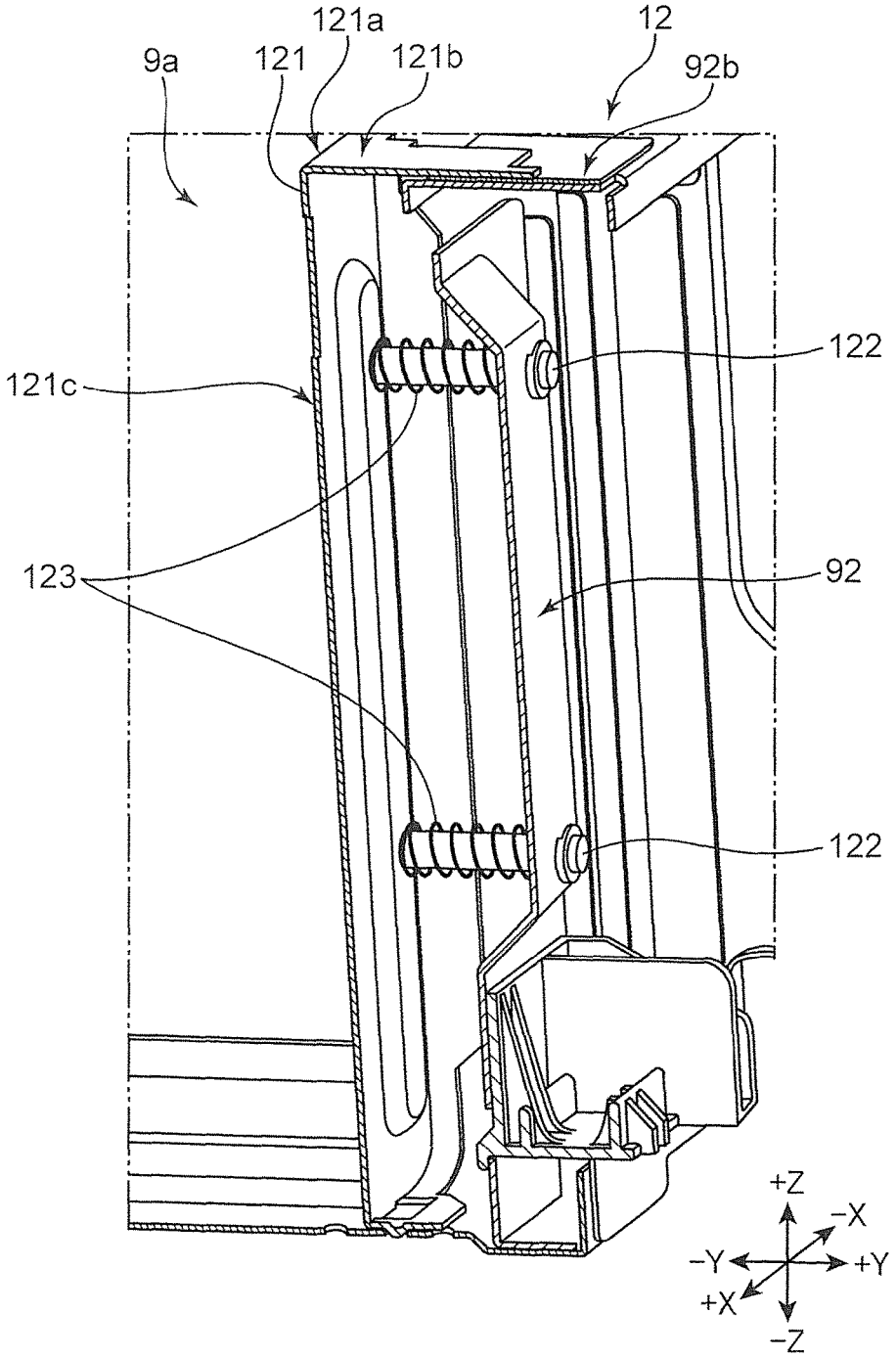
FIG. 6 is a schematic cross-sectional view illustrating a configuration of a first cursor and a peripheral configuration thereof.
Figure 7:
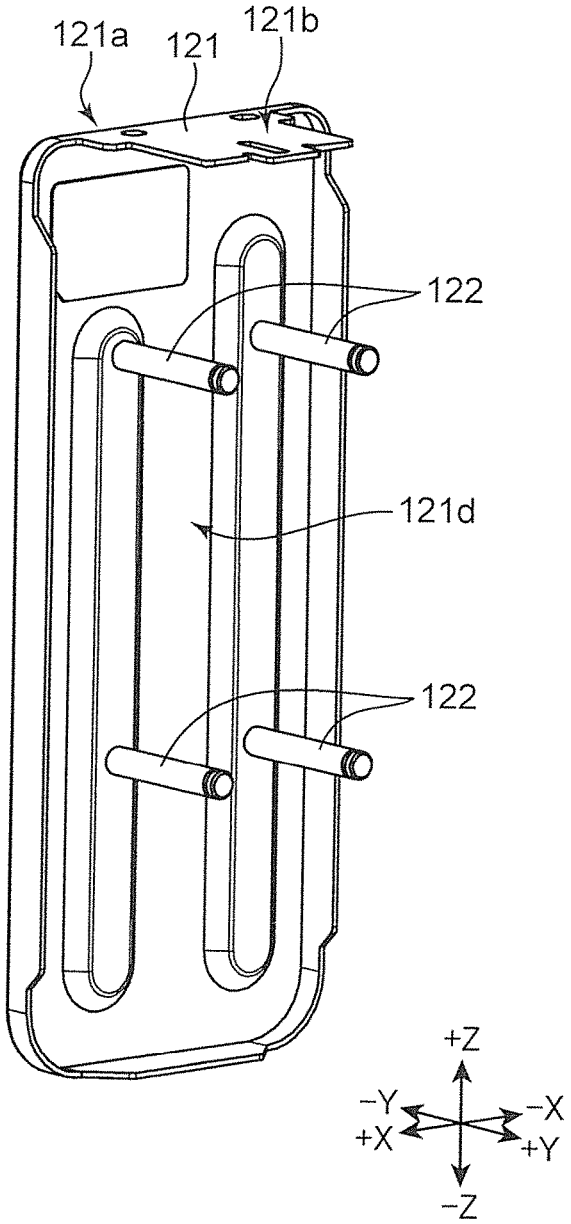
FIG. 7 is a schematic perspective view illustrating a guide plate and guide pins of the first cursor.
Figure 8:
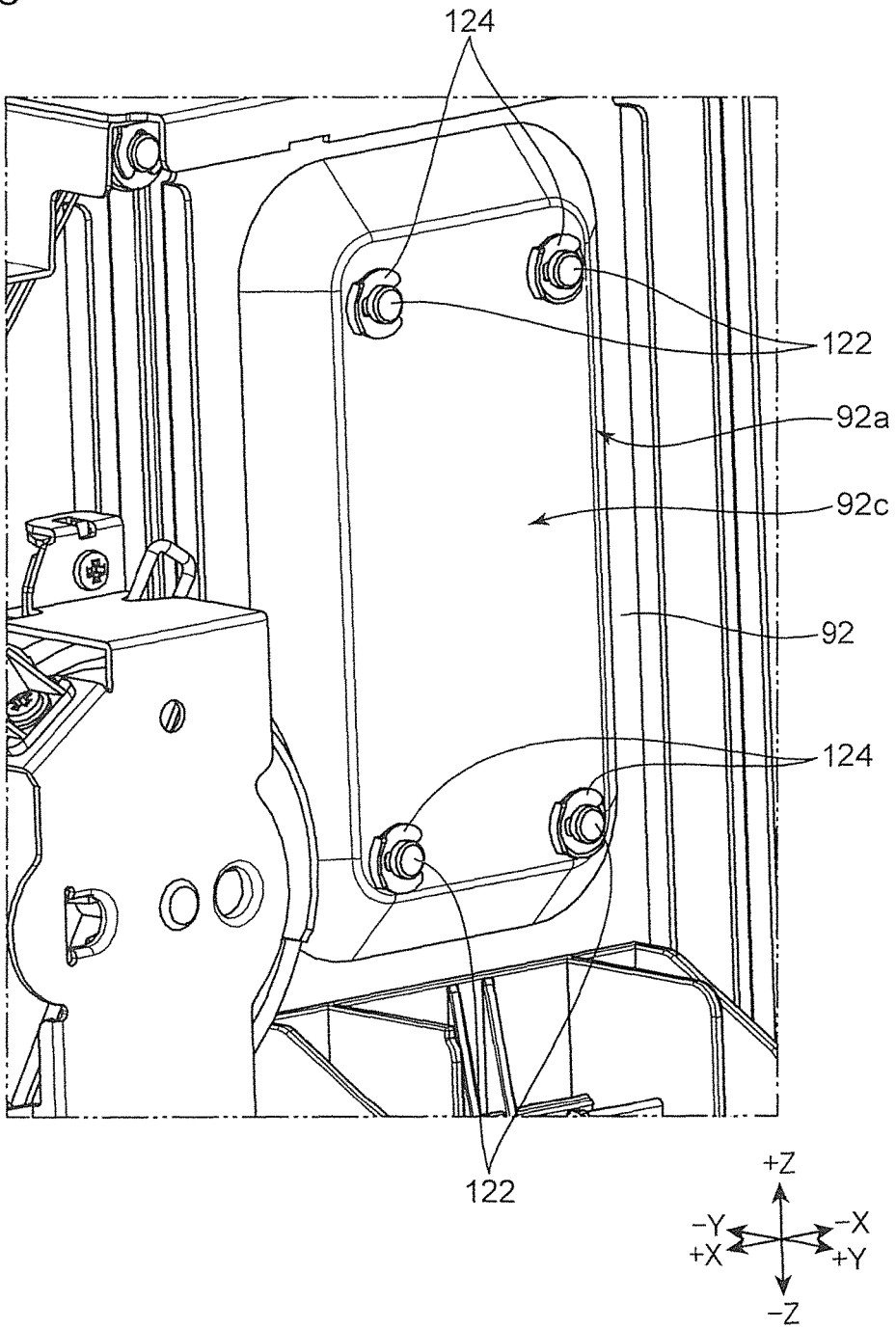

The configuration of the first cursor 12 and peripheral configuration thereof will be described with reference to FIGS. 6 to 8. FIG. 6 is a schematic sectional view illustrating the configuration of the first cursor 12 and peripheral configuration thereof. FIG. 7 is a schematic perspective view illustrating the guide plate 121 and the guide pins 122 of the first cursor 12. FIG. 8 is a schematic perspective view illustrating the region where the guide pins 122 pass through the rear wall 92.

As illustrated in FIGS. 6 and 8, the first cursor 12 includes the guide plate 121, the four guide pins 122, and four retaining members 124. Between the rear wall 92 and the face in +Y side (rear face) of the guide plate 121, a spring 123 is disposed as an urging member. Four springs 123 are disposed so as to be wound around the guide pins 122.

As illustrated in FIG. 6, the guide plate 121 is a plate member having a contact face 121*c* that comes in contact with the end in +Y side (the end in the back side) of the stack of sheets stored in the storage space 9*a* to guide the end. The contact face 121*c* extends in both X direction and Z direction. The guide plate 121 has an attachment tab 121*b* provided at the end in +Z side of the contact face 121*c* (upper end 121*a*) and is bent to +Y side. The attachment tab 121*b* is slidably attached on the attachment portion 92*b* of the rear wall 92.

As illustrated in FIG. 7, each of the four guide pins 122 is provided upright on a rear face 121*d*, which is in +Y side, of the guide plate 121 and extends toward +Y side. The contact face 121*c* and the rear face 121*d* are in front and back relationship.

As illustrated in FIG. 6, each of the four springs 123 is disposed between the guide plate 121 and the rear wall 92 of the cassette and wound around the respective guide pin 122. Note that the spring 123 keeps a large gap between the rear wall 92 and the guide plate 121 when no inertia of the stack of sheets acts (the state illustrated in FIG. 6).

As illustrated in FIG. 8, the retaining member 124 is attached to a distal portion of the guide pin 122 protruding further in +Y side than the outer wall face 92*c* of the rear wall 92. The retaining member 124 prevents the guide pin 122 from coming out of the through hole 92*b* when the guide plate 121 is pushed away, by the elastic force of the spring 123, at a farthermost position in −Y side (restriction position) from the rear wall 92.

When the sheet storage unit 7 is pushed into the apparatus body 6, the inertia of the stored stack of sheets forces the first cursor 12 to move, against the urging force of the spring 123, toward the retracted position in +Y side. That is, when the sheet storage unit 7 is pushed into the apparatus body 6, the first cursor 12 moves further in +Y side to decrease the gap between the rear wall 92 and the first cursor 12.

Meanwhile, after the sheet storage unit 7 has reached the fixed position in the apparatus body 6, the resilience of the spring 123 moves the first cursor 12, pushing the stack of sheets in −Y side, to the restriction position. That is, after the sheet storage unit 7 has reached the accommodated position in the apparatus body 6, the first cursor 12 moves further in −Y side to increase the gap between the rear wall 92 and the first cursor 12.

As illustrated in FIG. 8, the region where the guide pins 123 pass through the rear wall 92 (swell portion 92*a*) swelled further in the outer side (+Y side) than other regions. By providing the rear wall 92 with the swell portion 92*a* as described above, the spring 123 is given an extra height (stroke) in Y direction.

5. Configuration of Lift Plate 10

Figure 9:
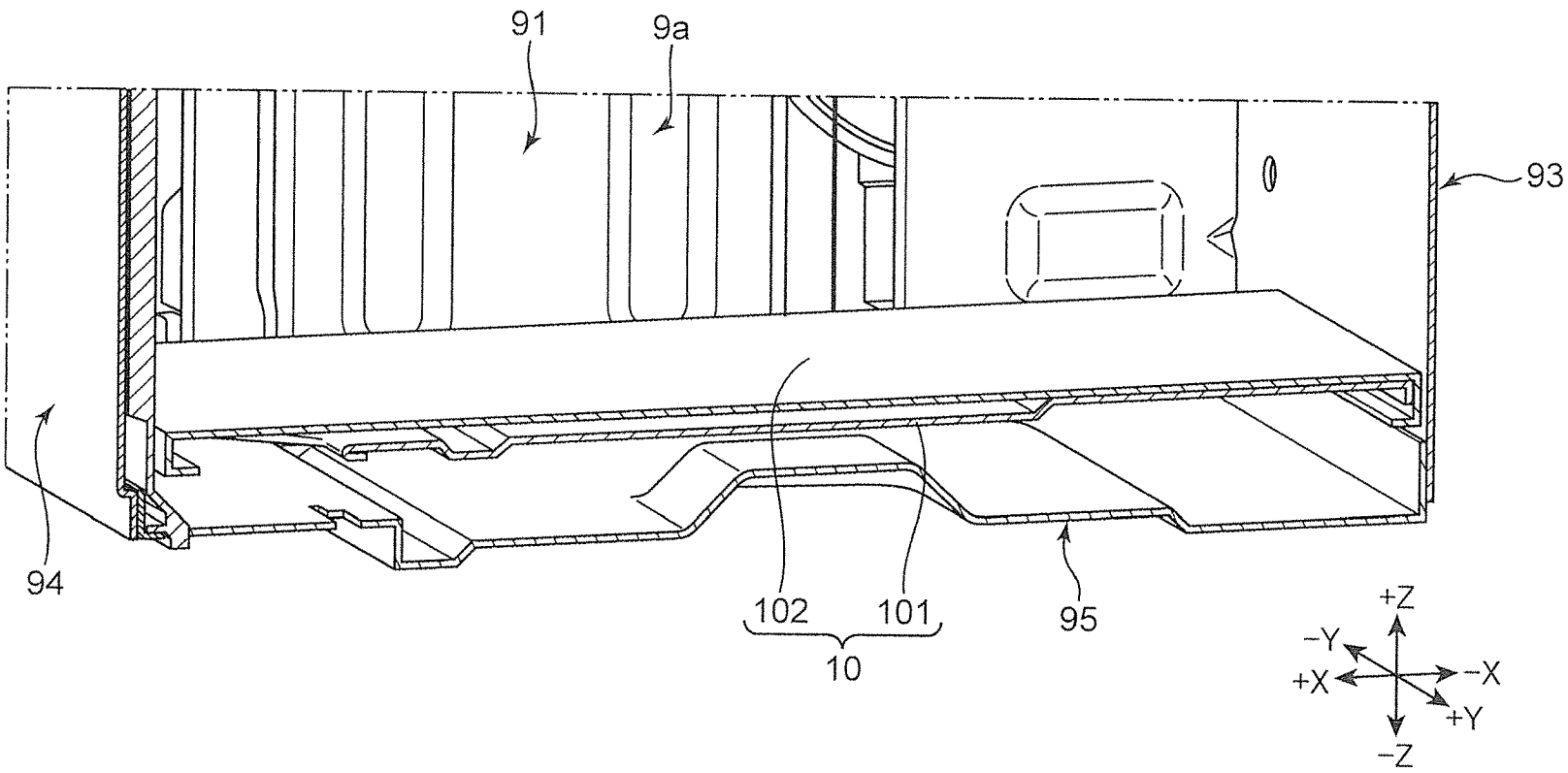
FIG. 9 is a schematic cross-sectional view illustrating a configuration of a lift plate of the sheet storage unit.

The configuration of the lift plate 10 serving as the bottom on which a stack of sheets is placed will be described with reference to FIG. 9. FIG. 9 is a schematic cross-sectional view illustrating the configuration of the lift plate 10 of the sheet storage unit 7.

As illustrated in FIG. 9, the lift plate 10 has a fixed plate 101 disposed in the upper side (+Z side) of a bottom wall 95 of the cassette 9 with a gap therebetween, and a movable plate 102 which is disposed on the upper face (face in +Z side) of the fixed plate 101 in a manner slidable in Y direction.

An end of each of the wires 113, 114, 117, and 118 illustrated in FIGS. 4 and 5 is connected to the fixed plate 101 (not illustrated in FIG. 9). In this manner, the fixed plate 101 and the movable plate 102 is raised and lowered in Z direction by the rotating shaft 111 rotating in conjunction with the rotating lift motor. As illustrated in FIGS. 4 and 5, the wires 113 and 114 are disposed further in −Y side than the front wall 91, and the wires 117 and 118 are disposed further in +Y side than the rear wall 92. Connections between the fixed plate 101 and the wires 113 and 114 are made further in −Y side than the front wall 91, and connections between the fixed plate 101 and the wires 117 and 118 are made further in +Y side than the rear wall 92.

The movable plate 102 is slidable against the fixed plate 101 in the push-in/pull-out direction (Y direction) of the sheet storage unit 7 to the apparatus body 6. The movement of the movable plate 102 in X direction perpendicular to the push-in/pull-out direction is restricted. The movable plate 102 moves together with the first cursor 12 in Y direction. In other words, since the first cursor 12 is also supported in a manner movable in Y direction, the first cursor 12 moves in Y direction as the movable plate 102 moves. In this configuration, the relative position of the first cursor 12 to the end of the movable plate 102 does not change by the movement of the first cursor 12 caused by an impact created by pushing in the sheet storage unit 7. This prevents bends and folds of sheets.

6. Pushing Sheet Storage Unit 7 into Apparatus Body 6

Figure 10:
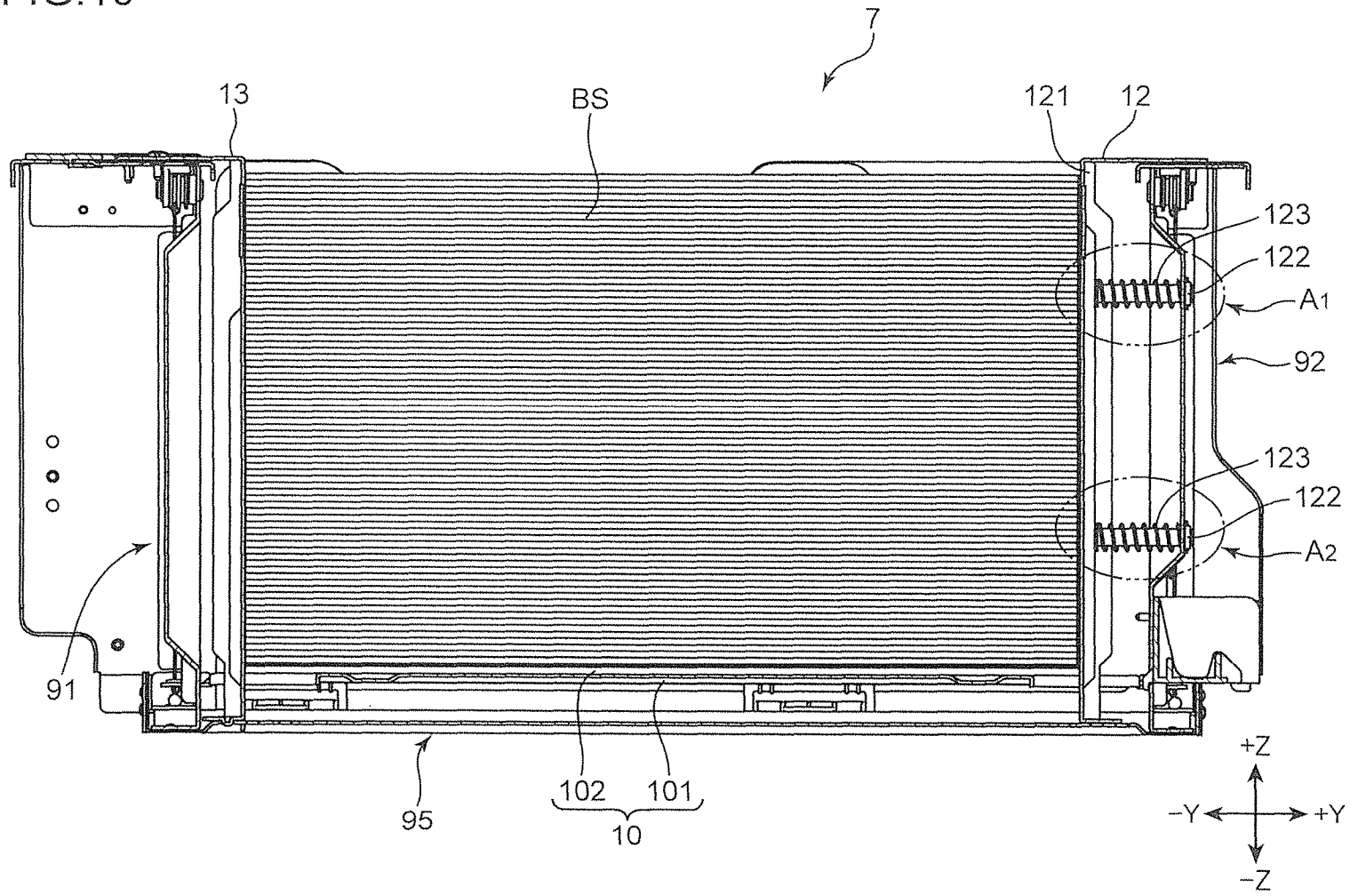
FIG. 10 is a schematic cross-sectional view illustrating a stack of sheets stored in a storage space of the sheet storage unit.
Figure 11:
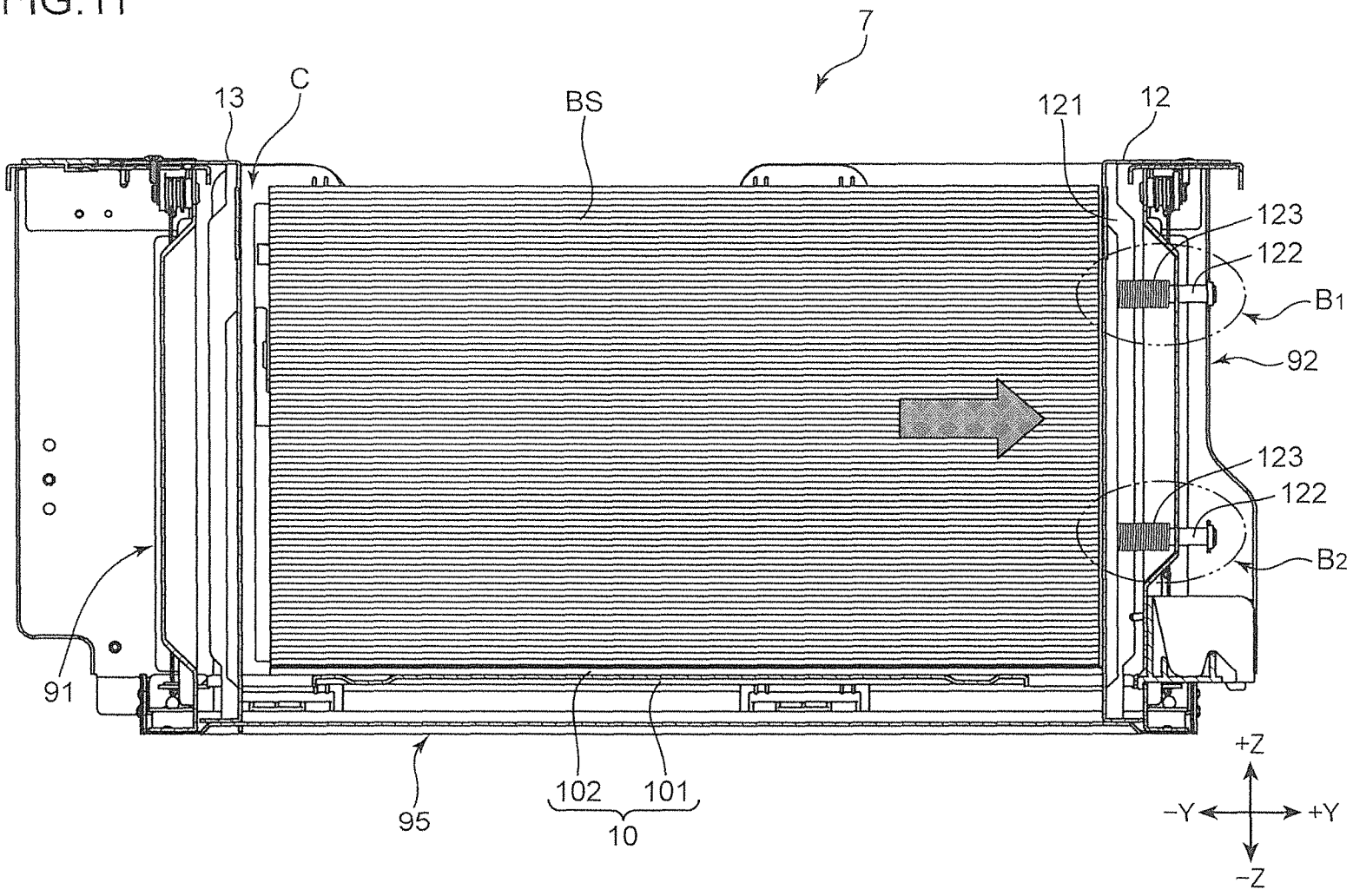
FIG. 11 is a schematic cross-sectional view illustrating the sheet storage unit pushed into the apparatus body with a relatively high velocity.

Pushing the sheet storage unit 7 into the apparatus body 6 will be described with reference to FIGS. 10 and 11. FIG. 10 is a schematic cross sectional view illustrating a stack of sheets BS stored in the sheet storage unit 7. FIG. 11 is a schematic cross-sectional view illustrating the sheet storage unit 7 pushed into the apparatus body 6 with a relatively high velocity.

As illustrated in FIG. 10, the stack of sheets BS, which is a large number of stacked sheets, is stored in the sheet storage unit 7. Before storing the stack of sheets BS in the sheet storage unit 7, the sheet storage unit 7 is pulled out to −Y side from the apparatus body 6 as illustrated in FIG. 3.

As illustrated in FIG. 10, the stack of sheets BS is stored in the sheet storage unit 7 with the bottom on the movable plate 102 of the lift plate 10, the end in −Y side restricted by the second cursor 13, and the end in +Y side (corresponding to the first side face) restricted by the first cursor 12. Regarding the front side and the back side of the sheets, though not illustrated in FIG. 10, the ends of the stack of sheets BS are also restricted by the side walls 93 and 94.

In a state illustrated in FIG. 10, the spring 123 is somewhat contracted than its natural length to urge the first cursor 12 (see portions indicated by arrows A1 and A2) with the retaining member 124, attached to the guide pin 122, in contact with the rear wall 92 to position the first cursor 12 in a predetermined position (restriction position). The guide plate 121 of the first cursor 12 thus restricts the end of the stack of sheets BS almost without a gap.

As illustrated in FIG. 11, when the sheet storage unit 7 storing the stack of sheets BS is pushed into the apparatus body 6 with a relatively high velocity and then reaches and stops at the accommodated position, the stack of sheets BS having inertia moves to +Y side as indicated by an arrow.

In the state illustrated in FIG. 11, the inertia of the stack of sheets BS causes the guide plate 121 of the first cursor 12 to move, against the urging force of the spring 123, toward +Y side together with the stack of sheets BS. The guide pin 122 thereby protrudes to +Y side while the spring 123 is contracted (refer to the portion indicated by arrows B1 and B2), and thus the gap between the guide plate 121 and the rear wall 92 becomes small.

The movement of the first cursor 12 as described above allows the stack of sheets BS to temporarily (instantaneously) move to +Y side, and thus a gap is formed between the second cursor 13 and the stack of sheets BS as indicated by an arrow C.

As illustrated in FIG. 11, the inertia of the stack of sheets BS causes the movable plate 102 of the lift plate 10 to move together with the first cursor 12 to +Y side. Thus, collapse of the stack of sheets BS is avoided. Furthermore, bends and folds of sheets can be prevented, because the movable plate 102 of the lift plate 10 slides in Y direction together with the guide plate 121 of the first cursor 12, thereby keeping the relative position of the first cursor 12 to the movable plate 102 unchanged.

When the sheet storage unit 7 reaches the accommodated position in the apparatus body 6, the resilience of the spring 123 causes the first cursor 12 and the movable plate 102 to move to −Y side, and thereby the stack of sheets BS is pushed back to −Y side. The stack of sheets BS thereby moves to the restriction position where the end in −Y side is restricted by the second cursor 13 and the end in +Y side is restricted by the first cursor 12.

7. Effect

In the sheet feeding apparatus 4 according to the present embodiment, when the sheet storage unit 7 is pushed into the apparatus body 6, the first cursor 12 moves by the inertia of the stack of sheets BS, against the urging force of the spring 123, which is an urging member, toward the retracted position (position illustrated in FIG. 11). This movement absorbs the impact and thereby avoids deformation of or damage to the first cursor 12 even when the sheet storage unit 7 is pushed into the apparatus body 6 with a relatively high velocity.

Consequently, in the sheet feeding apparatus 4 according to the present embodiment having the sheet storage unit 7 that can be pushed into or pulled out of the apparatus body 6, deformation of or damage to the first cursor 12 can be avoided even under an impact caused by pushing the sheet storage unit 7 into the apparatus body 6.

Furthermore, the sheet feeding apparatus 4 according to the present embodiment includes the lift plate 10 that has the movable plate 102 slidable in Y direction on the upper face of the fixed plate 101. The movable plate 102 can smoothly slide in the push-in/pull-out direction (Y direction) of the sheet storage unit 7 on receiving the inertia of the stack of sheets BS.

Furthermore, the sheet feeding apparatus 4 according to the present embodiment allows the movable plate 102 of the lift plate 10 to move together with the first cursor 12 in the push-in/pull-out direction of the sheet storage unit 7 (Y direction). This keeps the relative position of the first cursor 12 to the movable plate 102 unchanged even when the stack of sheets BS moves back to −Y side after the sheet storage unit 7 has been pushed in, which thereby prevents bends and folds of sheets. The sheet feeding apparatus 4 according to the present embodiment can thus avoid jamming in the image forming apparatus 1.

The sheet feeding apparatus 4 according to the present embodiment includes the first cursor 12 having the guide plate 121 and the guide pin 122 with the spring 123 provided as the urging member. This simple structure avoids deformation of and damage to the first cursor 12 caused by an impact and also avoids the rise in manufacturing cost.

Furthermore, the sheet feeding apparatus 4 according to the present embodiment includes the first cursor 12 also having the retaining member 124 that prevents the guide pin 122 from coming out of the through hole 92*b* of the rear wall 92 when the first cursor 12 moves in a pull-out direction (−Y direction) by the resilience of the spring 123. As a result, higher reliability can be obtained.

Furthermore, the sheet feeding apparatus 4 according to the present embodiment includes the lift unit 11 simply configured with the wires 113, 114, 117, and 118 and the rotating shaft 111. This simple configuration avoids the increase in manufacturing cost, allows smooth feeding of a sheet to the sheet conveying unit 5, and enables storing of the large stack of sheets BS.

The image forming apparatus 1 according to the present embodiment includes the sheet feeding apparatus 4 which provides the effect obtained by the sheet feeding apparatus 4 as described above.

(Second Embodiment)

Figure 12:
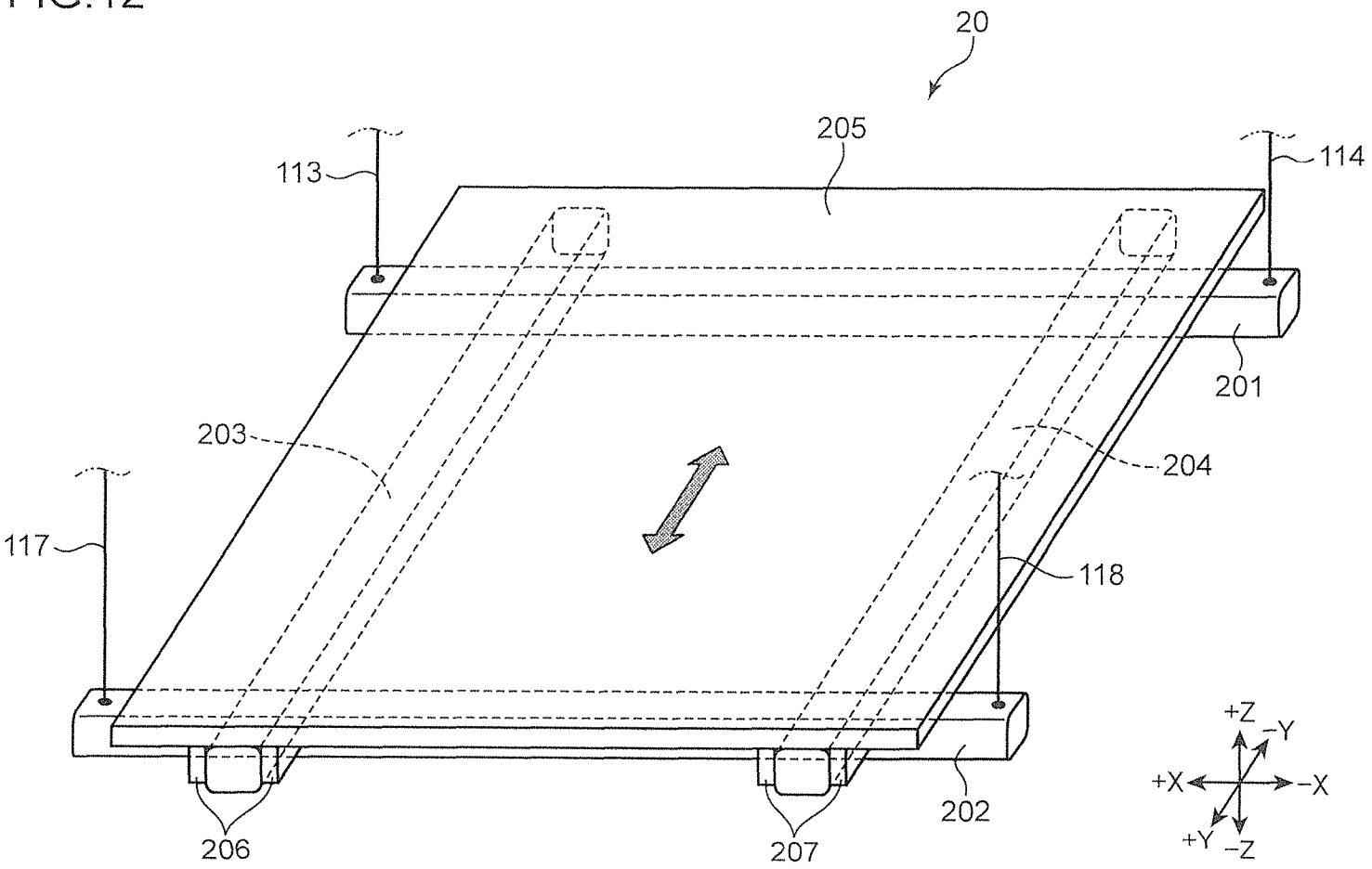
FIG. 12 is a schematic perspective view illustrating the configuration of the lift plate of the sheet storage unit in the sheet feeding apparatus according to the second embodiment.
Figure 13:
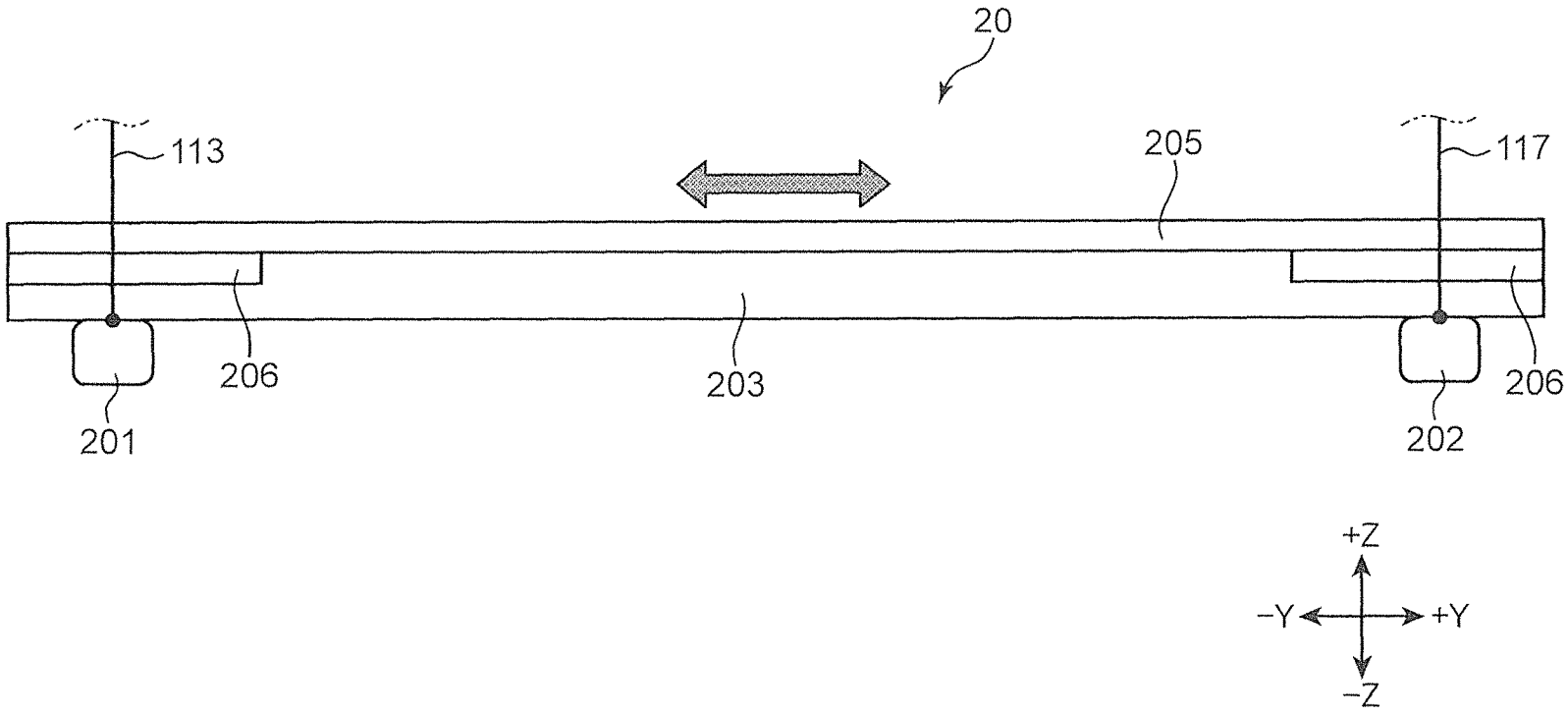
FIG. 13 is a schematic side view illustrating the configuration of the lift plate.

The configuration of the sheet feeding apparatus according to a second embodiment will be described with reference to FIGS. 12 and 13. In the following description, the configuration of the lift plate 20, which is the difference from the sheet feeding apparatus 4 according to the first embodiment, will be described, and description on the other configurations will be omitted. FIG. 12 is a schematic perspective view illustrating the configuration of the lift plate 20 of the sheet storage unit in the sheet feeding apparatus according to the second embodiment. FIG. 13 is a schematic side view illustrating the configuration of the lift plate 20.

As illustrated in FIG. 12, the lift plate 20 according to the present embodiment has a portion including support shafts 201 and 202 and slide shafts 203 and 204 (corresponding to the fixed plate 101 of the first embodiment). The lift plate 20 includes a movable plate 205 which is slidable in Y direction against the fixed plate.

The support shaft 201 and the support shaft 202 each extending in X direction are spaced apart in Y direction. The wires 113 and 114 of the lift unit 11 are attached to the ends of the support shaft 201, and the wires 117 and 118 are attached to the ends of the support shaft 202.

The slide shaft 203 and the slide shaft 204 each extending in Y direction are spaced apart in X direction. The slide shafts 203 and 204 are attached to the upper side (+Z side) of the support shafts 201 and 202 to serve as guiding members against which the movable plate 205 slides.

As illustrated in FIG. 12, the movable plate 205 has guides 206 and 207 provided in −Z side. The guides 206 are disposed on both sides, with respect to X direction, of the slide shaft 203, and the guides 207 are disposed on both sides, with respect to X direction, of the slide shaft 204. As illustrated in FIG. 13, each guide 206 is constituted of divided portions separated in Y direction, which portions are fixed to the bottom face of the top plate 205 at both ends with respect to Y direction.

The guides 206 and 207 on the movable plate 205 constitute guided members in which the slide shafts 203 and 204 fit.

With the configuration described above, the movable plate 205 of the lift plate 20 is movable in the push-in/pull-out direction (Y direction) of the sheet storage unit 7 to the apparatus body 6.

Thus, also in the present embodiment, the movable plate 205 moves in Y direction together with the first cursor 12 when the inertia of the stack of sheets BS created by pushing in the sheet storage unit 7 causes the first cursor 12 to move in Y direction. As in the first embodiment, collapse of the stack of sheets BS caused by pushing in the sheet storage unit 7 can be avoided, and jamming in the image forming apparatus 1 can further surely be avoided.

As described above, the sheet feeding apparatus and the image forming apparatus according to the present embodiment respectively have the same configuration as the sheet feeding apparatus 4 and the image forming apparatus 1 according to the first embodiment except for the lift plate 20. Thus, the same effect as described above can be obtained.

(Exemplary Modification)

In the first embodiment and the second embodiment described above, not both the first cursor 12 and the second cursor 13 of the sheet storage unit 7 but only the first cursor 12 provided in the back side (+Y side) with respect to the push-in direction to the apparatus body 6 is movable in Y direction. However, the present disclosure is not limited to such a configuration. For example, the second cursor 13 can also be configured movable in Y direction. Furthermore, a cursor provided for X direction in the sheet storage unit 7 may be configured the same as the first cursor 12.

In the first embodiment and the second embodiment described above, the sheet storage unit 7 of the sheet feeding apparatus 4 employs the first cursor 12. However, the present disclosure is not limited to such a configuration. For example, the sheet storage unit 8 may be configured the same as the first cursor 12, or both the sheet storage units 7 and 8 may be configured the same as the first cursor 12.

In the first embodiment and the second embodiment, the spring 123, which is a coil spring, is used as an example urging member. However, the present disclosure is not limited to such a configuration. For example, a leaf spring or a rubber can be used.

In the first embodiment and the second embodiment, the spring 123 is disposed between the guide plate 121 and the rear wall portion 92. However, the present disclosure is not limited to such a configuration. For example, a pin receiver for receiving the guide pin 122 may be provided in the outer side of the rear wall 92, and an urging member may be disposed between the pin receiver and the outer face of the rear wall 92.

In the first embodiment and the second embodiment, the guide plate 121 of the first cursor 12 and the movable plates 102 and 205 of the lift plates 10 and 20 move together in Y direction. However, the present disclosure is not limited to such a configuration. These components need not move together. The lift plate is not necessarily slidable in Y direction but may be fixed not to move in Y direction. Also in this case, collapse of the stack of sheets BS can be avoided by considering the coefficient of friction against the stack of sheets BS.

In the first embodiment, the lift plate 10 includes the fixed plate 101 and the movable plate 102. However, the number of plates constituting the lift plate is not limited to such a configuration in the present disclosure. The lift plate may be constituted by three or more layered plates.

In the second embodiment, the movable plate 205 is slidable against the two slide shafts 203 and 204. However, the present disclosure is not limited to such a configuration. For example, three or more shafts may be disposed below the movable plate 205. The cross-sectional shape of the shaft is not limited to a quadrangular cross section but may be a circle, an oval, or a polygon such as a hexagon.

In the first embodiment and the second embodiment, the example mechanism including the four wires 113, 114, 117, and 118 is provided as the lift unit 11 for lifting and lowering the lift plates 10 and 20. However, the present disclosure is not limited to such a configuration. For example, a rack and pinion mechanism may be used.

In the first embodiment and the second embodiment, the single first cursor 12 is provided for the rear wall 92 of the sheet storage unit 7 of the sheet feeding apparatus 4. However, the present disclosure is not limited to such a configuration. For example, two or more cursors may be provided in parallel for the rear wall.

Furthermore, in the sheet storage unit 7, cursors may be provided for all four sides of the stack of sheets BS in such a manner that all the cursors move in conjunction. Such a configuration can prevent collapse of the stack of sheets even if the stack of sheets moves by an impact.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A sheet feeding apparatus comprising:

an apparatus body;

a sheet storage unit which is opened to an upper side and has a storage space for storing a stack of sheets, the sheet storage unit being able to be pushed into and pulled out of the apparatus body;

a lift plate which is disposed parallel to a bottom wall of the storage space and can be raised and lowered;

a lift unit which raises and lowers the lift plate;

a first cursor provided upright on the bottom wall at a back side with reference to a push-in direction in which the sheet storage unit is pushed into the apparatus body such that the first cursor extends along a sheet feeding direction, the first cursor restricting an end, in the back side, of the stack of sheets; and an urging member disposed between rear wall and the first cursor to urge the first cursor, the rear wall defining an end in the back side of the storage space, the urging member being elastically deformable in a push-in/pull-out directions, wherein the first cursor comes in contact with a first side face, which is a side face of the stack of sheets, and is movable between a restriction position where the first cursor restricts the stack of sheets from moving in the push-in direction and a retracted position to which the first cursor retracts in the back side from the restriction position, the lift plate includes a fixed plate connected to the lift unit and a movable plate on which the stack of sheets is placed, the movable plate being movable on the fixed plate in the push-in/pull-out direction, and by inertia force of the stack of sheets, which generates when the sheet storage unit is pushed into the apparatus body and stops at a predetermined position, the stack of sheets moves together with the movable plate to the back side of the storage space to push the first cursor, the first cursor moves, by the inertia against an urging force of the urging member, toward the retracted position and then moves, pushing back the stack of sheets, by resilience of the urging member to the restriction position.

2. The sheet feeding apparatus according to claim 1, wherein the fixed plate of the lift plate includes a pair of guide portions extending in the push-in/pull-out directions, and the movable plate includes a pair of guide plates provided on a bottom face thereof, each of the pair of the guide portions fitting in a corresponding one of the guide plates in a slidable manner.

3. The sheet feeding apparatus according to claim 1, wherein at least one through hole is provided in the rear wall of the sheet storage unit, the first cursor includes a guide plate with having a contact face that comes in contact with the first side face of the stack of sheets, and at least one guide pin provided on a rear face, which is a back side of the contact face, to protrude toward the rear wall of the sheet storage unit to pass through the through hole, and the urging member is at least one coil spring disposed between the guide plate and the rear wall, the coil springs is inserted through the guide pin.

4. The sheet feeding apparatus according to claim 3, wherein the at least one through hole includes four through holes, the at least one guide pin includes four guide pins, and the at least one coil spring includes four coil springs.

5. The sheet feeding apparatus according to claim 3, wherein the rear wall of the sheet storage unit has a swell portion having a region which swells further in the back side, the through hole is formed on the swell portion.

6. The sheet feeding apparatus according to claim 3, wherein the first cursor further includes a retaining member attached to a distal portion of the guide pin passing through the through hole to prevent the guide pin from coming out of the through hole, and the first cursor moves in a pull-out direction opposite the push-in direction by resilience of the urging member and stops at the restriction position by the retaining member coming in contact with an outer wall face of the rear wall.

7. The sheet feeding apparatus according to claim 1, wherein the lift unit includes wires connected to the fixed plate of the lift plate and suspended via pulleys, and a rotating shaft that rotates by a rotational driving force of a driving source to wind up and wind out the wire.

8. An image forming apparatus comprising:

a sheet feeding apparatus according to claim 1;

a sheet conveying unit that conveys a sheet fed by the sheet feeding apparatus; and an image forming unit that forms an image on the sheet conveyed by the sheet conveying unit.

9. A sheet feeding apparatus comprising:

an apparatus body;

a sheet storage unit which is opened to an upper side and has a storage space for storing a stack of sheets, the sheet storage unit being able to be pushed into and pulled out of the apparatus body;

a lift plate which is disposed parallel to a bottom of the storage space and can be raised and lowered;

a lift unit which raises and lowers the lift plate;

a first cursor provided upright on the bottom wall at a back side with reference to a push-in direction in which the sheet storage unit is pushed into the apparatus body, the first cursor restricting an end, in the back side, of the stack of sheets; and an urging member disposed between a rear wall and the first cursor to urge the first cursor, the rear wall defining an end in the back side of the storage space, the urging member being elastically deformable in a push-in/pull-out directions, wherein the first cursor comes in contact with a first side face, which is a side face of the stack of sheets, and is movable between a restriction position where the first cursor restricts the stack of sheets from moving in the push-in direction and a retracted position to which the first cursor retracts in the back side from the restriction position, the lift plate includes a fixed plate connected to the lift unit and a movable plate on which the stack of sheets is placed, the movable plate being movable on the fixed plate in the push-in/pull-out direction, by inertia force of the stack of sheets, which generates when the sheet storage unit is pushed into the apparatus body and stops at a predetermined position, the stack of sheets moves together with the movable plate to the back side of the storage space to push the first cursor, the first cursor moves, by the inertia against an urging force of the urging member, toward the retracted position and then moves, pushing back the stack of sheets, by resilience of the urging member to the restriction position, at least one through hole is provided in the rear wall of the sheet storage unit, the first cursor includes a guide plate having a contact face that comes in contact with the first side face of the stack of sheets, and at least one guide pin provided on a rear face, which is a back side of the contact face, to protrude toward the rear wall of the sheet storage unit to pass through the through hole, and the urging member is at least one coil spring disposed between the guide plate and the back side wall, the coil springs is inserted through the guide pin.

10. The sheet feeding apparatus according to claim 9, wherein the at least one through hole includes four through holes, the at least one guide pin includes four guide pins, and the at least one coil spring includes four coil springs.

11. The sheet feeding apparatus according to claim 9, wherein the rear wall of the sheet storage unit has a swell portion having a region which swells further in the back side, the through hole is formed on the swell portion.

12. The sheet feeding apparatus according to claim 9, wherein the first cursor further includes a retaining member attached to a distal portion of the guide pin passing through the through hole to prevent the guide pin from coming out of the through hole, and the first cursor moves in a pull-out direction opposite the push-in direction by resilience of the urging member and stops at the restriction position by the retaining member coming in contact with an outer wall face of the rear wall.

* * * * *